US007340928B2

(12) United States Patent
Hoffman

(10) Patent No.: US 7,340,928 B2
(45) Date of Patent: Mar. 11, 2008

(54) CASEMENT LOCK WITH AUTOMATIC MOUNTING

(75) Inventor: Rainer Hoffman, Langenfeld (DE)

(73) Assignee: EMKA Beschlagteile GmbH & Co. KG (DE)

( * ) Notice: Subject to any disclaimer, the term of this patent is extended or adjusted under 35 U.S.C. 154(b) by 56 days.

(21) Appl. No.: 11/395,953

(22) Filed: Mar. 31, 2006

(65) Prior Publication Data

US 2006/0218982 A1 Oct. 5, 2006

(30) Foreign Application Priority Data

Apr. 1, 2005 (DE) ..... 10 2005 014 899

(51) Int. Cl.
*E05B 65/44* (2006.01)
*E05B 9/08* (2006.01)

(52) U.S. Cl. ..... 70/78; 70/370; 70/451

(58) Field of Classification Search ..... 70/78–81, 70/84, 451, 466, 369–371, 367, 379 R, 380; 411/550, 553

See application file for complete search history.

(56) References Cited

U.S. PATENT DOCUMENTS 2,040,258 A * 5/1936 Jacobi ..... 70/370
2,281,443 A * 4/1942 Jones ..... 411/550
4,067,090 A * 1/1978 Schenk ..... 411/554
4,756,638 A * 7/1988 Neyret ..... 403/261
5,368,427 A * 11/1994 Pfaffinger ..... 411/553
5,413,392 A * 5/1995 Schlack et al. ..... 292/204
6,508,092 B1 * 1/2003 Laabs et al. ..... 70/370
6,523,379 B2 * 2/2003 Teskey ..... 70/371
6,668,602 B2 * 12/2003 Graham et al. ..... 70/208
6,901,638 B2 * 6/2005 Itou et al. ..... 24/570
2002/0026817 A1 * 3/2002 Greer ..... 70/370

* cited by examiner

*Primary Examiner*—Suzanne Dino Barrett
(74) *Attorney, Agent, or Firm*—Robert W. Becker; Robert W. Becker & Assoc.

(57) ABSTRACT

A casement lock for mounting on a cabinet part, especially without the use of a tool. A housing is adapted to be fixedly mounted in an opening of the cabinet part, and an operating shaft is rotatably mounted in the housing. A locking ring is disposed on an inner part of the housing to fasten the housing to the cabinet. The locking ring is axially displaceable on the housing part against the force of a spring supported on the housing. Projections on the housing axially engage in radially extending extensions of the cabinet opening. The locking ring has locking dogs that are offset relative to the housing projections and have inclined surfaces.

10 Claims, 4 Drawing Sheets

CASEMENT LOCK WITH AUTOMATIC MOUNTING

BACKGROUND OF THE INVENTION

The present invention relates to a casement lock for mounting on a cabinet part such as a door, a cover or the like and comprises a housing, which can be fixedly mounted in an opening that is located in the cabinet part, and further comprising an operating shaft that is arranged in the housing so as to be pivotable. On the outside of the cabinet part, the operating shaft can be coupled with a closing or locking means such as a handle, a key, a cylinder lock or the like, and on the inside of the cabinet part, a casement tongue is attached to the operating shaft so as to move with it. By pivoting the operating shaft between stops that are fixedly attached to the housing, the casement tongue can be shifted between a locked and an unlocked position. The housing with the pre-mounted casement tongue can be introduced through the opening in the cabinet part and can be fastened to the cabinet part via a fastening means that is located on the inner portion of the housing that extends through.

A casement lock having the aforementioned features is known from DE 200 19 247 U1. In order to mount the casement lock in the opening of the cabinet part, the housing is introduced into the opening in the cabinet part from the outside of the cabinet part. On the inside, a fastening nut with an internal tread is screwed onto the portion of the housing which protrudes through the cabinet part and which is provided with an external thread. The fastening nut is tightened with a tool. Associated with the known casement lock is therefore the disadvantage that a loosely enclosed nut, which for the mounting has to be handled separately, is part of the casement lock that is delivered for the mounting. Besides, a tool is necessary for accomplishing the mounting.

It is therefore an object of the present application to configure a casement lock having the aforementioned features in such a way that its mounting on the cabinet part is facilitated, and can in particular be accomplished without having to use a tool.

SUMMARY OF THE INVENTION

The fundamental concept of the invention is that the opening comprises at least one radial extension and the housing comprises at least one projection which, when the housing is mounted, axially engages into the extension; furthermore, the fastening means comprises a locking ring that is movable in an axial direction on the inner housing portion against the force of a spring that is supported on the housing, but is connected to the housing portion so as to not be pivotable relative to the housing portion. The locking ring has at least one locking dog, which extends towards the cabinet part and is offset by a certain angle in relation to the projection of the housing. For the mounting of the casement lock, the locking dog can be introduced through the opening having the extension. The locking dog has, starting at its front end that is directed towards to the cabinet part, an inclined surface that faces in a predefined mounting direction and extends, in a circumferential direction, in an inclined manner in relation to the longitudinal axis of the casement lock.

The invention has the advantage that the entirely pre-assembled casement lock, having no loose mounting components, merely needs to be introduced into the opening of the cabinet part and rotated in an indicated mounting direction via the closing or locking means. On the one hand, due to that mounting rotation, the projections that are located on the housing engage into the extensions that are located on the opening and therefore secure the housing in the cabinet part so as to not be pivotable. On the other hand, resulting from the mounting rotation, the locking ring with its locking dogs is independently pivoted into a position in which the locking dogs of the locking ring, through the force of the spring that is supported on the housing, are pressed against the inside of the cabinet part and therefore secure the housing in the opening in the axial direction.

According to one particular embodiment of the invention, the locking ring that rests against the inside of the cabinet part is pretensioned by means of a compression spring, which is supported on a spring abutment that is located on the inner portion of the housing.

In an advantageous embodiment of the invention, the spring abutment is configured as a disk that is adjustable on the protruding or inner housing portion. According to one embodiment of the invention, the outer periphery of the inner housing portion can be provided with a thread on which the disk is infinitely movable. This makes it possible to regulate or adjust the tension of the spring that acts upon the locking ring and hence also the mounting force that is to be applied when rotating the housing in the mounting direction.

According to one embodiment of the invention, the compression spring is configured as a flat wire spring.

Essentially, one projection and one locking ring with one locking dog are sufficient for the implementation of the fundamental concept of the invention. For a better distribution of forces, several extensions that are located on the opening, several projections that are located on the housing and engage into the extensions and further several locking dogs that are located on the locking ring are distributed over the periphery of the casement lock in a symmetrical arrangement. It has hereby proven to be advantageous to provide four extensions, four projections and four locking dogs respectively offset by 90 degrees from each other.

In the context of such an arrangement, the locking dogs on the locking ring, which is arranged on the housing so as to not be pivotable in relation to the housing, can be offset by an angle of 45 degrees in relation to the projections of the housing. Furthermore, the inclined planes of the locking dogs can be arranged with an angle of less than 45 degrees relative to the longitudinal axis of the casement lock.

Provided that, by means of adjusting the spring abutment, the casement lock can be utilized for cabinet parts having different wall thicknesses, markings corresponding to the wall thickness of the cabinet part for positioning of the disk that serves as a spring abutment can be placed on the inner housing portion, according to one embodiment of the invention.

BRIEF DESCRIPTION OF THE DRAWINGS

One exemplary embodiment of the invention, which is described below, is represented in the drawings, in which.

DESCRIPTION OF SPECIFIC EMBODIMENTS

Figures 1, 2, 3:
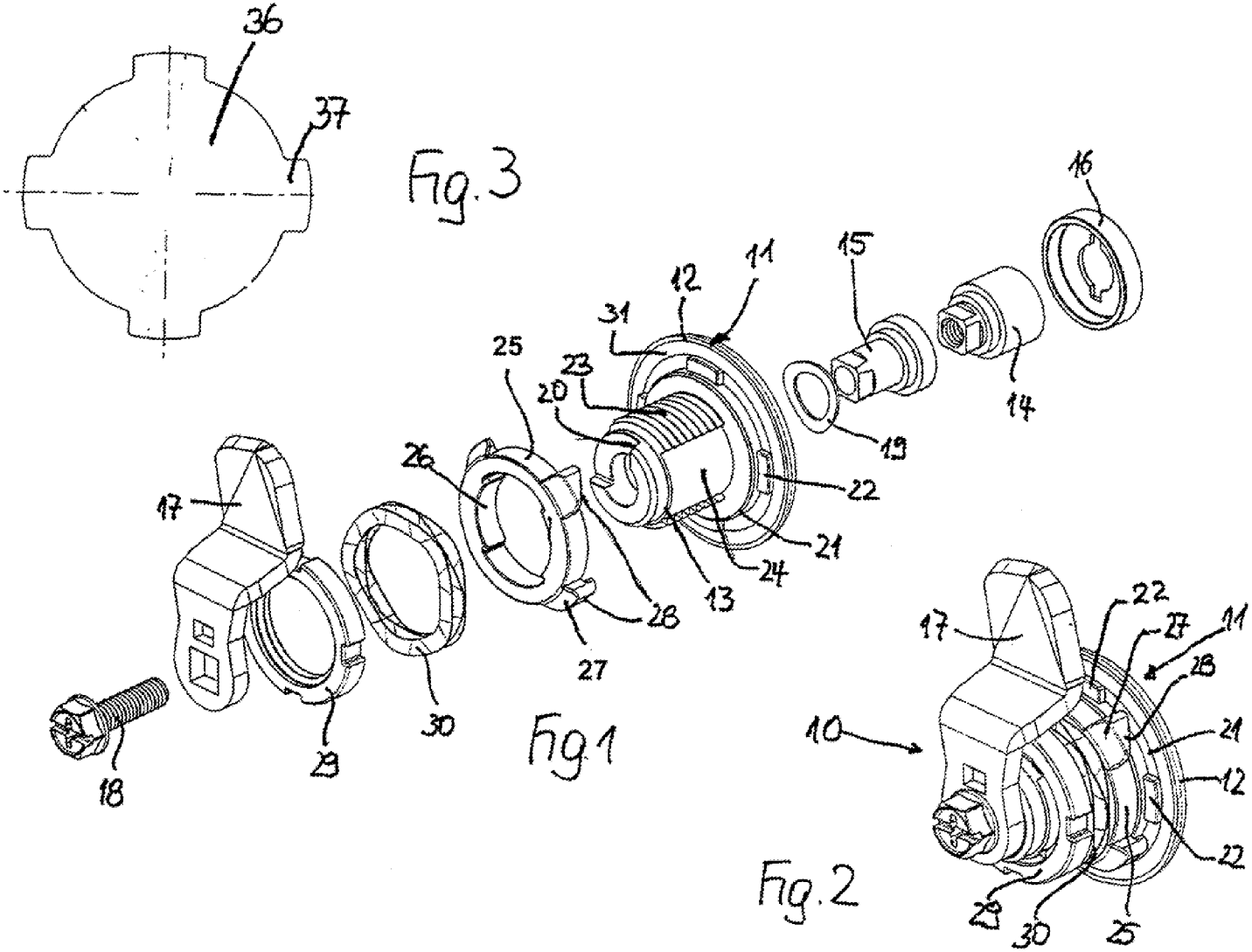
FIG. 1 shows the components of a casement lock in an exploded perspective representation.
FIG. 2 shows the pre-assembled casement lock according to FIG. 1.
FIG. 3 shows an opening that is to be located in the cabinet part in order to receive the casement lock according to FIG. 2 in plan view.

The casement lock 10, which can be seen in its entirety in FIG. 2, comprises a housing 11 with a housing flange 12, which is provided with a gasket 31, and which is located on the outside of the corresponding cabinet part when the casement lock is mounted. The casement lock 10 further comprises an inner housing portion 13 that protrudes through the cabinet part. Pivoted in the housing 11 is an operating shaft, which comprises an adapter 14 and an actuating insert 15. Towards the outside, the housing is covered with a holding cap 16, which has an opening that is adapted to the shape of a closing or locking means that cooperates with the actuating insert, in the case in question, a key.

A casement tongue 17 can, through the intermediary of a lock or spring washer 19, be attached to the end of the adapter 14 of the operating shaft, which is therefore configured as a square end, and can be bolted to the actuating insert 15 with a bolt 18 in such a way that the casement tongue 17 rotates along when the actuating insert 15 with the adapter 14 is rotated. The relative rotation of the casement tongue 17 in relation to the housing 11 is limited by housing stops 20 that are located on the end of the inner housing portion 13.

For the mounting of the casement lock 10 in a corresponding opening of a cabinet part, the housing 11 primarily comprises, adjacent to the outer housing flange 12, a flange base 21 that engages into the opening of the cabinet part. Four projections 22, offset by 90 degrees from each other, radially extend from the flange base 21.

The inner housing portion 13 is provided with an external thread in the area of two thread lands 23 that are located opposite from each other. A locking ring 25, which engages into the spaces 24 between the thread lands 23 via inner fixation projections 26, can be slid onto the inner housing portion 13, so that the locking ring 25 is movable on the inner housing portion in an axial direction, but is secured so as to not be pivotable in relation to the inner housing portion. The locking ring 25 is provided with locking dogs 27 that axially protrude towards the outer housing flange 12. When the locking ring 25 is slid onto the inner housing portion 13, the locking dogs 27 are offset by 45 degrees in relation to the projections 22 of the housing 11, so that a locking dog 27 is located between each two projections 22. The locking dogs have inclined surfaces 28 that, starting at their front, free ends, face in a predefined mounting direction and extend, in the circumferential direction, in an inclined manner with an angle of less that 45 degrees in relation to the longitudinal axis of the casement lock.

A disk 29 is screwed onto the end of the inner housing portion onto the thread lands 23 thereof. Via corresponding screwing motions, the position of the disk 29 on the inner housing portion 13 is movable in the axial direction, so that different distances between the disk 29 and the locking ring 25 can be set. Located between the disk 29 and the locking ring 25 is a flat wire spring 30 that functions as a compression spring. It is supported on the disk 29, which serves as a spring abutment, and pretensions the locking ring 25, which is movable on the inner housing portion 13, in the direction of the outer housing flange 12 of the housing 11.

In FIG. 2, the casement lock 10, configured as described above, is represented in the assembled position. The aperture in the cabinet part, preferably the door of a switching cabinet, that is necessary for the mounting of the casement lock 10 represented in FIG. 2, is illustrated in FIG. 3. The aperture comprises a circular opening, which is adapted to the preferably cylindrical shape of the housing portion 13 that is to be introduced. Four extensions 37 originate from the opening 36; they are distributed over the outer perimeter of the opening and are offset by 90 degrees from each other. The extensions thereby have a shape that corresponds to the shape or dimension of the projections 22 on the housing 11 of the casement lock 10 so that, in the mounted position of the casement lock 10, the projections 22 properly engage into the extensions 37. Simultaneously, the dimension of the locking dogs 27 located on the locking ring 25 is determined in such a way that the locking dogs 27 fit through the extensions 37 of the opening 36 (see FIGS. 4-7). Likewise, the outer diameter of the locking ring 25 and of the disk 29 are configured in such a way that those components can be introduced through the opening 36 when the casement lock 10 is mounted in the opening 36 with its extensions 37.

The casement lock 10, as shown in FIG. 2, is pre-assembled for its mounting in the opening 36 with the extensions 37 in the cabinet part 35. For the mounting, the casement tongue 17 is shifted into the end position on the corresponding housing stop 20 that faces the direction of rotation for the mounting. In the inside view of the cabinet part according to the representation in FIGS. 4 through 9, the direction of rotation for the mounting is defined as clockwise. That means that the key, as the intended closing or locking means, is to be turned counterclockwise.

Figure 5:
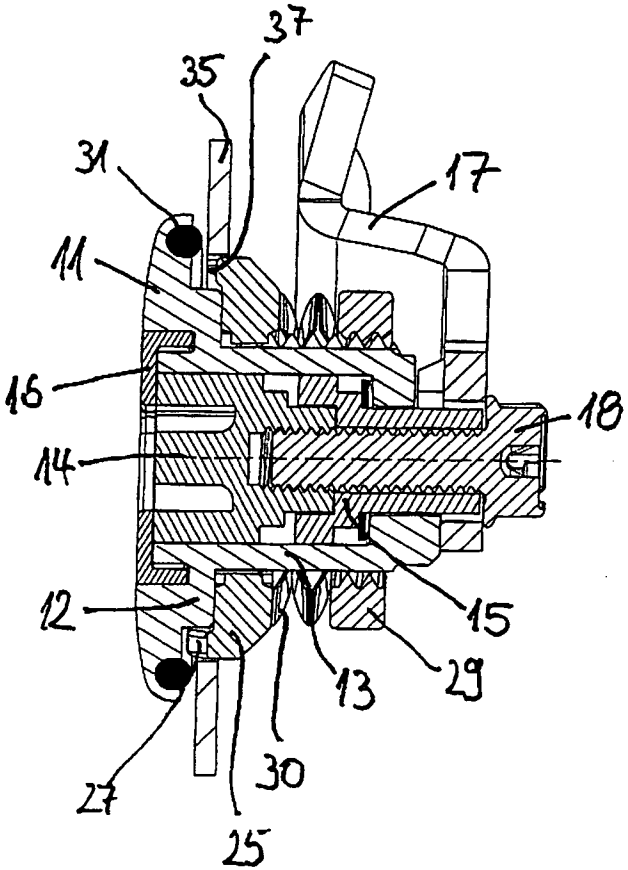
FIG. 5 shows the object of FIG. 4 in a sectioned side view.
Figure 4:
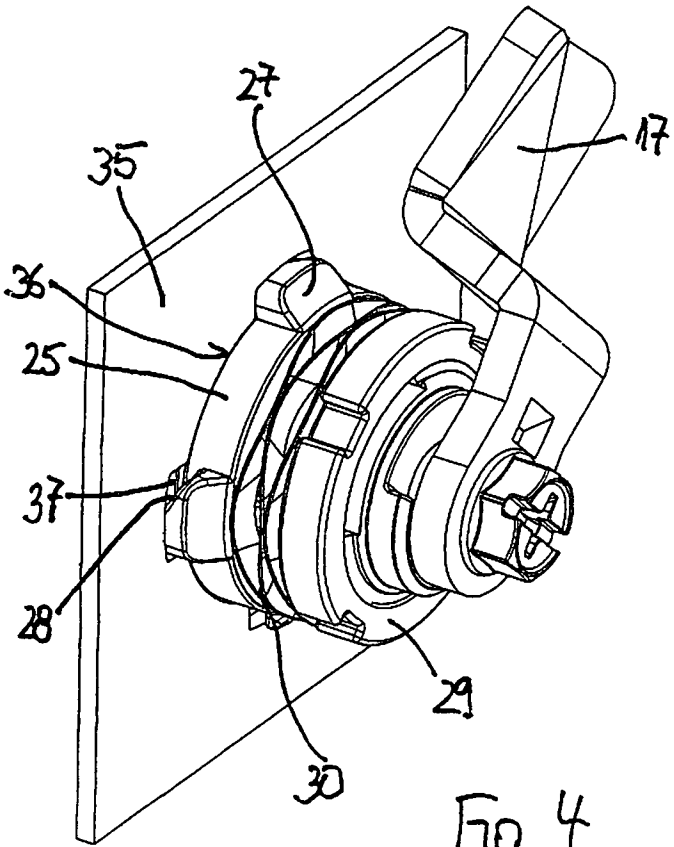
FIG. 4 shows the casement lock according to FIG. 1 in the beginning stage of the mounting on a cabinet part.
Figure 7:
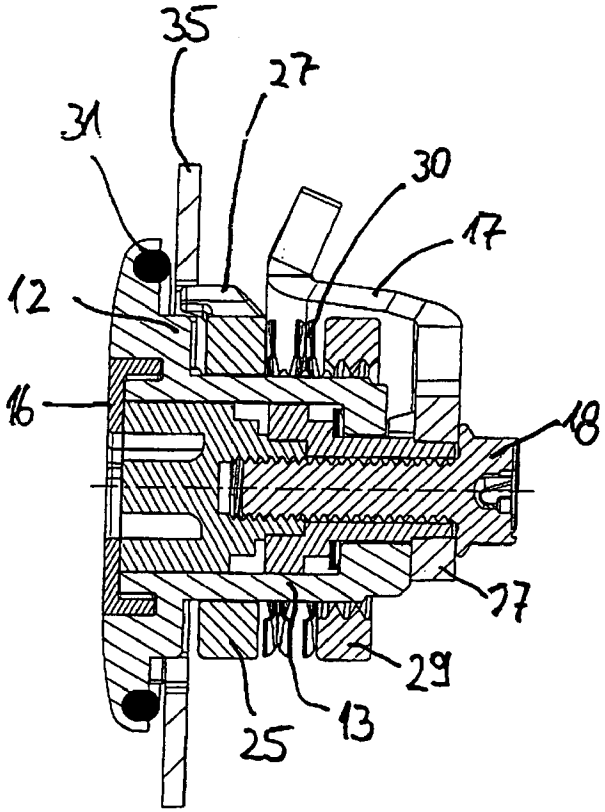
FIG. 7 shows the object of FIG. 6 in a sectioned side view.
Figure 6:
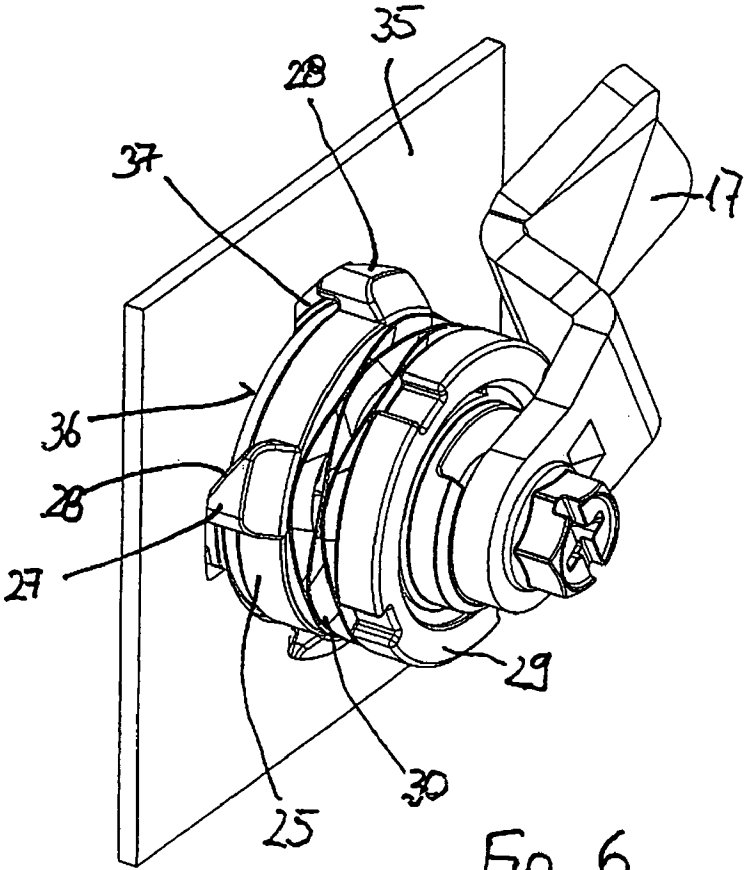
FIG. 6 shows the casement lock according to FIG. 4 in a stage during the mounting rotation of the housing.

As can be seen primarily from FIGS. 4 and 5, the casement lock 10 with the casement tongue 17, the disk 29 and the locking ring 25 is introduced through the opening 36 with the extensions 37, whereby the locking dogs 27 come to rest in the extensions 37 of the opening 36. The locking dogs 27 that rest in the extensions 37 are offset by 45 degrees in relation to the projections 22 of the housing 11 that are located on the outside of the cabinet part 35. As a result, the projections 22 of the housing, in the position according to FIGS. 4 and 5, are supported on the outside surface of the cabinet part 35. In that position, the inclined surfaces 28 of the locking dogs 27 that face in the mounting direction rest against the associated, radially extending edge of the corresponding extension 37. If, as shown in FIGS. 6 and 7, the operating shaft 14, 15 with the casement tongue 17 is rotated further in the mounting direction by means of the key, they, due to the casement tongue 17 abutting against the corresponding housing stop 20, there results a rotation of the entire housing 11 of the casement lock 10. Due to the fixation of the locking ring 25 on the inner housing portion 13 that impedes pivoting of the locking ring 25 relatively to the housing portion 11, the rotation of the housing 11 causes the inclined planes 28 of the locking dogs 27 on the locking ring 25 to slide off the associated edges of the extensions 37, so that, when the housing 11 is rotated, the locking ring 25 independently moves in the axial direction against the tension of the flat wire spring 30.

Figure 9:
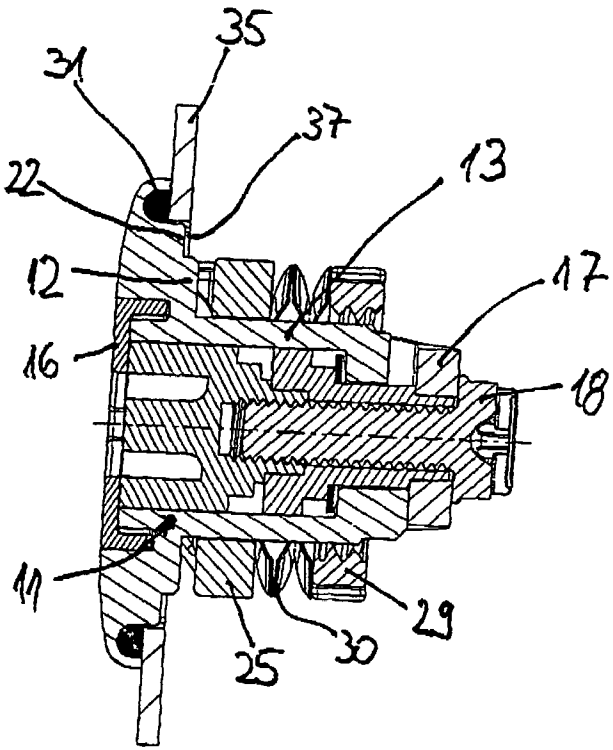
FIG. 9 shows the object of FIG. 8 in a sectioned side view.
Figure 8:
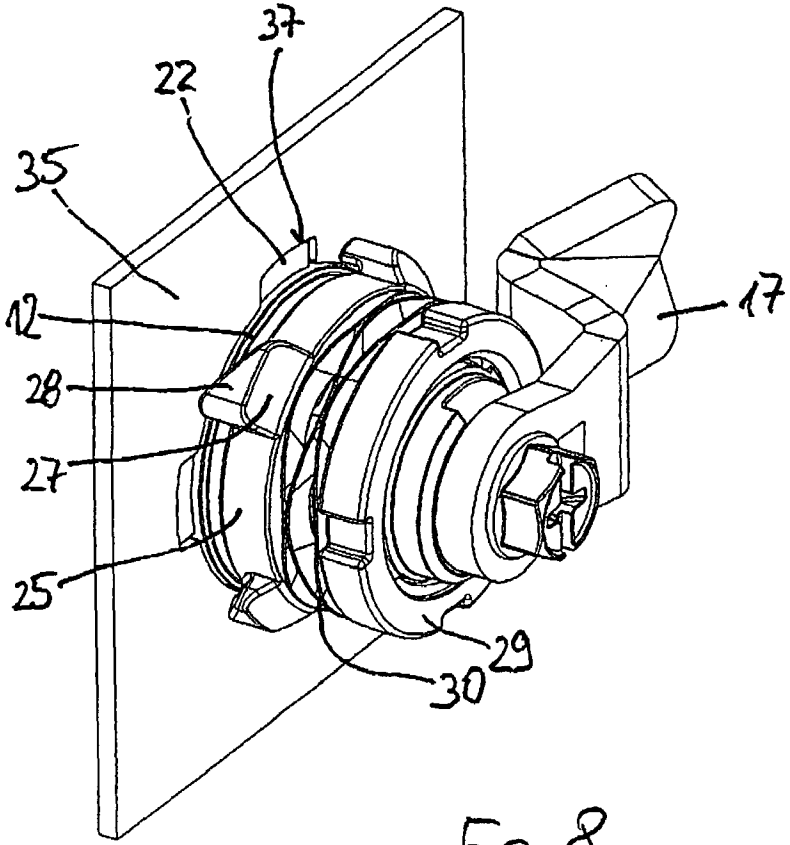
FIG. 8 shows the casement lock according to FIG. 6 after completion of the mounting rotation.

When the rotation of the housing 11 in the direction of mounting has proceeded to such extent that the locking dogs have entirely left the extensions 37 of the openings 36 in the cabinet part 35, the projections 22 located on the housing 11 snap into the extensions 37, whereby the flange base 21 of the housing 11 simultaneously comes to rest in the opening 36 of the cabinet part 35. The flat wire spring 30, which is supported on the disk 29 that is secured on the inner housing portion 13, presses the axially movable locking ring 25 with the locking dogs 27 against the inner surface of the cabinet part 35. By means of that counter pressure, the housing 11 of the casement lock is secured between its outer flange 12 and the locking ring 25 via the pretension that is generated by the spring effect. That position is shown in FIGS. 8 and 9, in which the casement tongue 17 assumes its locking position as well. Since the housing 11 is secured on the cabinet part 35 so as to not be pivotable due to the fact that the projections 22 are engaged into the extensions 37, rotation of the operating shaft 14, 15 via the key now results in a shifting of the casement tongue 17 between the locking position (FIG. 8) and the opening position (not represented).

The casement lock is easily demountable from the cabinet part 35 by unscrewing the disk 29, which untensions the flat wire spring 30. When the flat wire spring 30 is untensioned, the locking ring 25 can be moved in the axial direction until the housing is pivotable in such a way that the locking dogs 27 of the locking ring 25 fit through the extensions 37 of the opening 36 again.

The tension of the flat wire spring 30 against the locking ring 25 can be manipulated by adjusting the disk 29 on the inner housing portion 13, so that consequently the force that is to be applied when rotating the housing 11 in the mounting direction via the engaged closing or locking means can be regulated or limited. In addition, the positioning of the disk 29, which serves as a spring abutment, permits different wall thicknesses of the cabinet part 35, since the required axial movement of the locking ring 25 on the inner housing portion 13 is defined by the wall thickness of the cabinet part 35.

The specification incorporates by reference the disclosure of German priority document 10 2005 014 899.9 filed Apr. 1, 2005.

The present invention is, of course, in no way restricted to the specific disclosure of the specification and drawings, but also encompasses any modifications within the scope of the appended claims.

I claim:

1. A casement lock adapted to be mounted on a cabinet part having an opening therefor, comprising:

a housing that is adapted to be fixedly mounted in the opening of the cabinet part, wherein said housing is provided with at least one projection adapted to axially engage at least one radially extending extension of the opening;

an operating shaft that is rotatably mounted in said housing, wherein a part of said operating shaft that is adapted to be disposed on an outside of the cabinet is adapted to be coupled with a closing or locking means;

a casement tongue fixedly connected to a part of said operating shaft that is adapted to be disposed on an inside of the cabinet, wherein said casement tongue is pivotable between a locking position and an unlocking position by rotation of said operating shaft between housing stops; and a fastening means disposed on a part of said housing that is adapted to be disposed on an inside of a cabinet for fastening said housing to the cabinet part, wherein said fastening means comprises a locking ring that is axially displaceable on said housing part against the force of a spring supported on said housing, wherein said locking ring is disposed on said housing part so as to be fixed against rotation relative thereto, wherein said locking ring has at least one locking dog, wherein said at least one locking dog is offset relative to said at least one projection of said housing by an angle, and wherein said at least one locking dog has an inclined surface that faces a mounting direction of rotation of said housing and in a peripheral direction of said locking ring is inclined relative to a longitudinal axis of said casement lock.

2. A casement lock according to claim 1, wherein said locking ring is adapted to be pre-tensioned against an inner surface of the cabinet part by said spring, and wherein said spring is a compression spring that is supported on a spring abutment that is disposed on said housing part.

3. A casement lock according to claim 2, wherein said spring abutment is a disk that is adjustably disposed on said housing part.

4. A casement lock according to claim 2, wherein an outer periphery of said housing part is provided with a thread on which said spring abutment is infinitely displaceable.

5. A casement lock according to claim 2, wherein said compression spring is a flat wire spring.

6. A casement lock according to claim 1, wherein symmetrically distributed over a periphery of said casement lock are a plurality of projections on said housing that are adapted to engage a plurality of extensions of the opening of the cabinet part and a plurality of locking dogs on said locking ring.

7. A casement lock according to claim 6, which includes four opening extensions that are offset from one another by 90°, four projections of said housing that are offset from one another by 90°, and four locking dogs of said locking ring that are offset from one another by 90°.

8. A casement lock according to claim 6, wherein said locking dogs of said locking ring are respectively offset by an angle of 45° relative to said projections of said housing.

9. A casement lock according to claim 6, wherein said inclined surfaces of said locking dogs are disposed at an angle of less than 45° relative to said longitudinal axis of said casement lock.

10. A casement lock according to claim 3, wherein markings corresponding to cabinet part thicknesses are adapted to be provided on said housing part for a positioning of said disk that serves as a spring abutment.

* * * * *